US007909044B2

(12) United States Patent
Tranchant et al.

(10) Patent No.: US 7,909,044 B2
(45) Date of Patent: Mar. 22, 2011

(54) APPLICATOR DEVICE FOR APPLYING A COSMETIC AND THE USE OF SUCH A DEVICE

(75) Inventors: Jean-François Tranchant, Marigny-les-Usages (FR); Marc Chevalier, Franconville (FR)

(73) Assignee: L V M H Recherche, Saint Jean de Braye (FR)

( * ) Notice: Subject to any disclaimer, the term of this patent is extended or adjusted under 35 U.S.C. 154(b) by 611 days.

(21) Appl. No.: 11/829,516

(22) Filed: Jul. 27, 2007

(65) Prior Publication Data

US 2008/0236608 A1 Oct. 2, 2008

(30) Foreign Application Priority Data

Mar. 30, 2007 (FR) ..... 07 02341

(51) Int. Cl.
*A45D 40/26* (2006.01)
*B43M 1/02* (2006.01)
*A47L 13/32* (2006.01)

(52) U.S. Cl. ..... 132/218; 401/1; 401/2

(58) Field of Classification Search ..... 132/218, 132/317, 217; 401/2, 1; 222/146.5
See application file for complete search history.

(56) References Cited

U.S. PATENT DOCUMENTS

| | | | | |
|---|---|---|---|---|
| 1,663,077 | A * | 3/1928 | Hallock | 222/146.5 |
| 3,744,921 | A * | 7/1973 | Weller et al. | 401/2 |
| 4,059,204 | A * | 11/1977 | Duncan et al. | 222/146.5 |
| 5,362,164 | A * | 11/1994 | Wingert | 401/2 |
| 5,775,344 | A | 7/1998 | Clay | |
| 7,090,420 | B2 | 8/2006 | De La Poterie | |
| 2005/0031400 | A1 | 2/2005 | Marcotte | |

FOREIGN PATENT DOCUMENTS

| | | |
|---|---|---|
| EP | 1 468 628 A1 | 10/2004 |
| EP | 1563760 | 8/2005 |
| WO | WO 2006/057071 A1 | 6/2006 |
| WO | WO 2006/057438 A1 | 6/2006 |
| WO | WO 2006/057439 A1 | 6/2006 |

OTHER PUBLICATIONS

French Search Report and written opinion FR 0702341 dated Nov. 14, 2007.

* cited by examiner

*Primary Examiner* — Robyn Doan
(74) *Attorney, Agent, or Firm* — Miller, Matthias & Hull, LLP

(57) ABSTRACT

An applicator device for applying a cosmetic, the applicator device comprising an elongate body adapted to be held in the hand, an applicator head, a feed device adapted to feed the applicator head with cosmetic in solid form, and a heater device adapted to heat the applicator head, thereby causing the cosmetic to melt. The feed device comprises a feed duct provided in the body of the applicator device and communicating with passageways that are provided in the applicator head and that open out to the outside, and the heater device is adapted to heat said feed duct at the applicator head.

12 Claims, 2 Drawing Sheets

FIG.1.
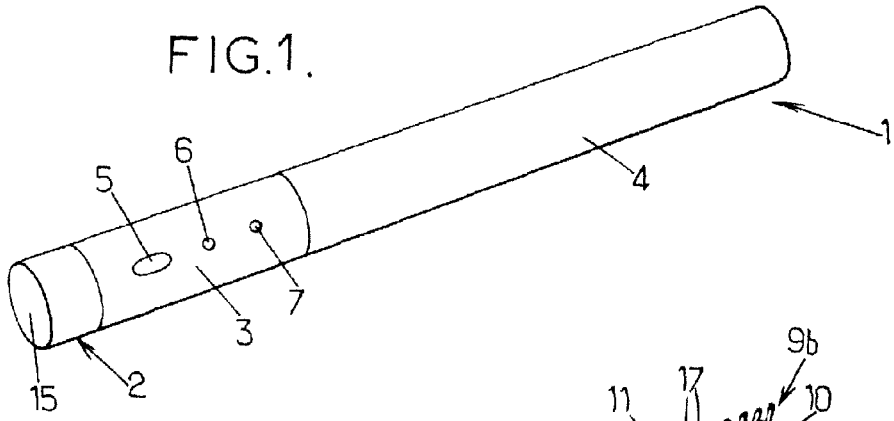
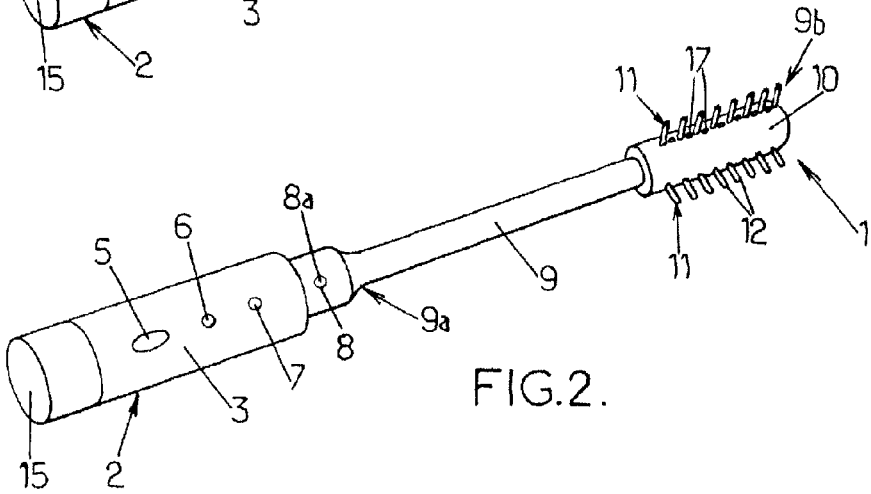
FIG.2.
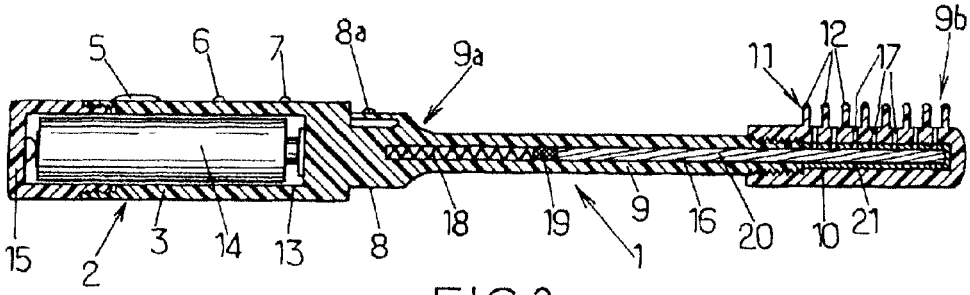
FIG.3.

APPLICATOR DEVICE FOR APPLYING A COSMETIC AND THE USE OF SUCH A DEVICE

The present invention relates to applicator devices for applying cosmetics, and to uses of such devices.

BACKGROUND OF THE INVENTION

More particularly, the invention relates to an applicator device for applying a cosmetic, the applicator device comprising:

an elongate body adapted to be held in the hand;

an applicator head adapted to apply the cosmetic over a portion of the body of a user (in particular for making up keratinous fibers such as eyelashes, eyebrows, and hair);

a feed device adapted to feed the applicator head with cosmetic in solid form; and a heater device adapted to heat at least the applicator head, thereby causing the cosmetic to melt.

Document WO-A-2006/057438 describes an example of such an applicator device, in which the feed device is separate from the body of the applicator device. That device suffers from the drawback of being complex, costly, and tedious to use.

OBJECTS AND SUMMARY OF THE INVENTION

A particular object of the present invention is to mitigate those drawbacks.

To this end, according to the invention, an applicator device of the type in question wherein the feed device comprises a feed duct provided in the body of the applicator device and communicating with passageways that are provided in the applicator head and that open out to the outside;

and wherein the heater device is adapted to heat said feed duct at the applicator head.

By means of these features, the applicator device of the invention is simpler, less costly, and easier to use than the above-mentioned prior art device.

In various embodiments of the invention, it is optionally possible to use one or more of the following features:

the heater device is adapted to heat said feed duct at the applicator head to a temperature lying in the range 35° C. to 80° C.;

the applicator device is adapted to apply mascara to the eyelashes of a user, and the heater device is adapted to heat said feed duct at the applicator head to a temperature lying in the range 40° C. to 60° C.;

the feed device comprises a thrust device adapted to push the solid cosmetic towards the applicator head inside the feed duct;

the thrust device comprises a spring disposed at the end of the feed duct that is remote from the applicator head;

the heater device comprises at least one resistive heater element;

the applicator head is provided with at least one row of teeth, the passageways in the applicator head opening out between the teeth;

the applicator device includes a control circuit having an actuating member and adapted to cause the heater device to operate for a predetermined time each time the actuator member is actuated;

said predetermined time lies in the range 30 seconds to 2 minutes;

the applicator device further comprises:

a cap adapted to cover the applicator head when said applicator is not being used; and a sensor adapted to detect the presence of the cap and then to prevent the heater device from operating;

the applicator device has solid cosmetic disposed in the feed duct, the cosmetic being in the form of at least one stick slidably engaged in the feed duct;

solid mascara is disposed in the feed duct; and the feed duct is adapted to be opened in order to be refilled with cosmetic.

In addition, the invention further provides the use of an applicator device as defined above, for applying a solid cosmetic (in particular mascara) by causing it to melt.

BRIEF DESCRIPTION OF THE DRAWINGS

Other characteristics and advantages of the invention appear from the following description of one of the embodiments thereof, given by way of non-limiting example, and with reference to the accompanying drawings, in which:

FIG. 1 is a perspective view of an embodiment of an applicator device of the invention;

FIG. 2 is a perspective view of the applicator device of FIG. 1, without its protective cap;

FIG. 3 is a longitudinal section view of the applicator device of FIG. 2;

Figure 4:
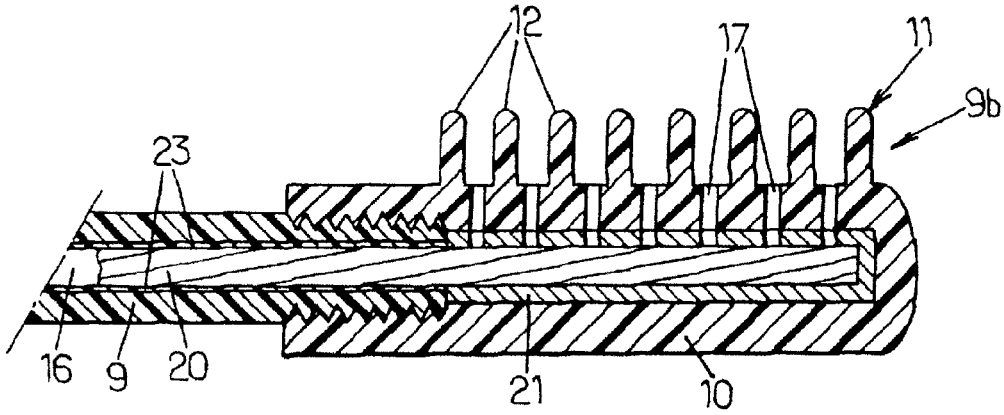
FIG. 4 is a detail view of FIG. 3 at the applicator head.

In the various figures, like references designate elements that are identical or similar.

MORE DETAILED DESCRIPTION

FIG. 1 shows an applicator device 1 for applying a cosmetic, in particular mascara, which applicator device is shown in the stowage position. In this position, the applicator device 1 has a generally elongate shape, e.g. it is substantially cylindrical. The applicator device 1 has an elongate body 2 made, for example, of a plastics material, having rear portion 3 adapted to be held in the hand by a user, and forming the rear portion of the applicator device 1.

In the example considered herein, said rear portion 3 of the body 2 can, in particular, being provided with a control button 5 and with two indicator lights 6, 7.

The applicator device 1 also has a cap 4 which can be fitted over the body 2 when the applicator device is in the stowage position, thereby forming the front portion of said applicator device.

As shown in FIG. 2, the cap 4 can, for example, fit over a smaller-diameter portion 8 of the body 2. Said smaller-diameter portion 8 is itself extended forwards by a rod 9 of diameter smaller than the diameter of said portion 8, the rod 9 extending between a proximal end 9*a* in the vicinity of the above-mentioned portion 8 and a distal end 9*b* that is provided with an applicator head 10. The applicator head 10 is adapted to apply the cosmetic to a portion of the body of the user, and, in particular, adapted to apply mascara on the eyelashes of a user.

The applicator head 10 is provided with one or more combs 11 (e.g. 3 combs 11 disposed at 120° relative to one another in the example shown herein), each of the combs 11 being constituted by one row of teeth 12 aligned in the longitudinal direction of the rod 9. Naturally, the applicator head 10 could have a number of combs 11 that is different from 3, e.g. 1, 2, or 4 combs. An embodiment having two combs disposed at 180° relative to each other is particularly advantageous.

In a variant, the applicator head could optionally have flexible bristles in place of the teeth 12.

The smaller-diameter portion 8 of the body 2 can further be provided with a sensor 8*a*, e.g. merely a contactor, for a purpose that is explained below.

As shown in FIGS. 3 and 4, the rear portion 3 of the body 2 can be provided with an internal cavity 13 housing an electric battery 14 (or a plurality of electric batteries). The cavity 13 can be opened, e.g. by unscrewing or detaching a rear cover 15 that forms the rear end of the body 2, so that it is possible to replace the battery(ies) 14.

In a variant, the applicator device 1 could be provided with a connector making it possible to recharge the battery(ies) 14 without having to change them.

In addition, a central feed duct 16 is provided in the rod 9, which central feed duct extends in the longitudinal direction of said rod 9, and is extended into the inside of the applicator head 10.

Said feed duct 16 communicates with passageways 17 in the form of channels, extending radially from the feed duct 16 and opening out to the outside of the applicator head 10 between the teeth 12 in each comb 11.

At that end of the feed duct 16 that is situated remote from the applicator head 10, a thrust device, e.g. a compression spring 18 acting on a pusher 19, is housed in said feed duct 16. The pusher 19 pushes a stick 20 of solid cosmetic away towards the applicator head 10.

The cosmetic in question is formulated in a manner such that it is in solid form at 25° C. The cosmetic can have a melting point lying, for example, in the range 40° C. to 60° C., and in particular around 50° C. The solid consistency of the cosmetic at 25° C. is obtained by incorporating therein a sufficient quantity of wax, in a manner known to the person skilled in the art.

In a preferred embodiment of the invention, the solid cosmetic is mascara that can, for example, be prepared from the following compounds, whose concentration is expressed in percentage by weight of the final composition:

| | |
|---|---|
| Hydrogenated vegetable oil (e.g. palm oil) | 40% to 50% |
| Caprylic/capric triglyceride | 5% to 10% |
| Polyethylene | 3% to 7% |
| Microcrystalline waxes | 1% to 5% |
| Talc | 1% to 5% |
| Glyceryl tripalmitate | 1% to 5% |
| Silicas | 0.5% to 1% |
| Pigments | 25% to 30% |

The stick 20 of cosmetic can, for example, have a length of a few centimeters (in particular approximately in the range 4 cm to 8 cm) and a diameter of a few millimeters (in particular in the range 1 mm to 4 mm). Such a stick can, in particular, be obtained by an extrusion method.

In a variant, the stick 20 of cosmetic can be replaced by a succession of cylindrical segments of cosmetic aligned one behind another in the feed duct 16, or indeed a series of solid beads of cosmetic aligned one behind another.

The feed duct 16 is adapted to be opened in a manner such that it is possible to replace the solid cosmetic that it contains. For example, the applicator head 10 can be screwed onto the end of the rod 9 so that the stick 20 of cosmetic can be inserted into the feed duct 16 from the distal end of said rod 9 when the applicator head 10 is unscrewed.

A resistive heater element 21 (a metal wire winding, a ceramic element, or some other element) is disposed in the applicator head 10, and preferably in the immediate vicinity of the feed duct 16, which resistive heater element is adapted to heat firstly the inside of the feed duct 16, at the applicator head 10, to a temperature lying, for example, in the range 35° C. to 80° C., and more particularly in the range 40° C. to 60° C. for mascara, so as to cause the cosmetic to melt. Melted by the heat given off, the cosmetic thus diffuses to the outside via the passageways 17 and is distributed between the teeth 12 of each comb 11 in uniform manner by capillary action. For example, the heater element 21 can surround the feed duct 16 in the applicator head 10.

It should be noted that the resistive heater element heats not only the duct 16, but also the entire applicator head 10. Advantageously, the applicator head 10 can be made of a material that is a good heat conductor, e.g. a metal material or a plastics material that is filled with a metal material.

Figure 5:
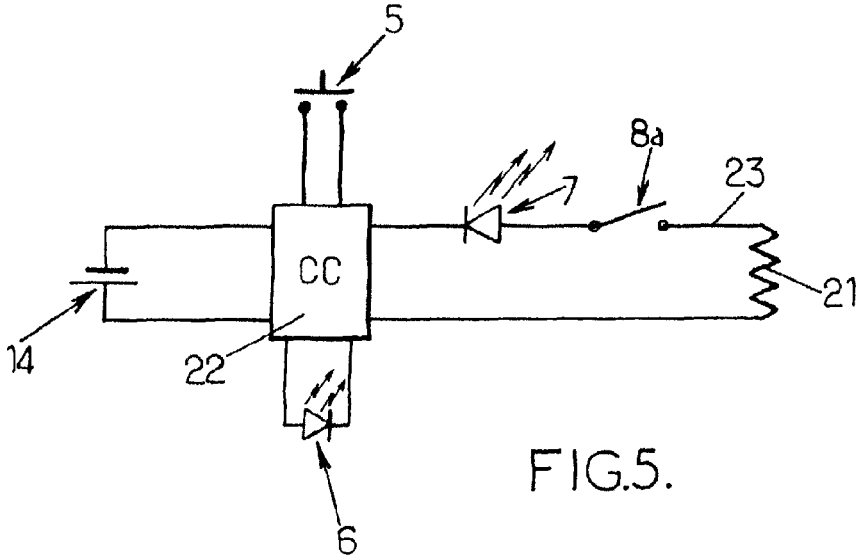
FIG. 5 is an electrical circuit diagram of the heater system of the applicator device of FIGS. 1 to 4.

As shown in FIG. 5, the resistive heater element 21 is powered by the batteries 14 via a control circuit 22 (CC) and via conductors 23 that extend through the rod 9 (the conductors 23 can be connected to the resistive heater element 21 via electrical contacts provided at that end of the rod 9 that is screwed into the applicator head 10).

The control circuit 22 is an electronic circuit adapted to power the resistive heater element 21 from the battery 14 for a predetermined time when a user presses on the control button 5. Said predetermined time can, for example, lie in the range 30 seconds to 2 minutes. The control circuit 22 can also optionally be adapted to switch on the indicator light 6, which, for example, is constituted by a red light-emitting diode (LED), when it detects insufficient voltage across the terminals of the battery 14, indicating that said battery is flat.

In the example shown in FIG. 5, the power supply circuit for powering the resistive heater element 21 from the control circuit 22 also includes:

- an LED, e.g. a green LED, constituting the above-mentioned indicator light 7, which is switched on when the resistive heater element 21 is being heated; and
- the above-mentioned contactor 8*a* which is adapted to open the power supply circuit for powering the resistive heater element 21 when said contactor is pushed radially inwards by the cap 4 fitted over portion 8 of the body 2, and to close when the cap 4 is removed (the contactor 8*a* thus prevents the resistive heater element 21 from operating inadvertently, if the control button 5 is unintentionally pressed while the applicator device 1 is in the stowage position.

The above-described device operates as follows: when a user wishes to apply mascara to the eyelashes, the user removes the cap 4 and depresses the control button 5, thereby triggering melting of the stick of mascara 20 in the internal duct at the applicator head 10, so that the mascara, as melted in this way, passes through the passageways 17 and spreads over the teeth 12 of the combs 11 after a few seconds.

It should be noted that it is possible to connect the light indicator 7 directly to the control circuit 22 which causes it to flash for a few seconds after the button 5 has been actuated (while the cosmetic melts), and which then causes it to be on continuously for the remainder of the time for which the heater element 21 is heated.

By means of the cosmetic being heated, the user can thus apply the cosmetic in the form of a film that is uniform and thus that is of improved quality. For mascara, the user can obtain particularly fine and effective coating of the eyelashes.

The user can then use the applicator for applying, for example, mascara to the eyelashes. Once the user has finished using the applicator 1, the user puts the cap 4 back in place, thereby automatically interrupting the power supply to the electric heater element 21 if the user ceases using the applicator after the above-mentioned predetermined operating time.

What is claimed is:

1. An applicator device for applying a cosmetic, the applicator device comprising:

an elongate body adapted to be held in the hand and including a rod which extends in a longitudinal direction up to a distal end, said distal end comprising an applicator head adapted to apply the cosmetic over a portion of the body of a user, said applicator head being provided with at least one row of protrusions chosen between teeth and bristles, which extend substantially perpendicular to said longitudinal direction;

a feed device adapted to feed the applicator head with cosmetic in solid form, said feed device comprising a feed duct provided longitudinally in the rod of the applicator device and communicating with passageways that are provided in the applicator head and that open out laterally to the outside between said protrusions;

a stick of solid cosmetic slidably engaged in the feed duct, said stick of solid cosmetic being adapted to melt when heated and said feed device further comprising a thrust device adapted to push the stick of solid cosmetic towards the applicator head inside the feed duct; and a heater device in the applicator head, said heater device being adapted to heat said feed duct at the applicator head for melting the stick of solid cosmetic and for having the molten cosmetic flow out of said passageways, and said heater device being further adapted to heat the entire applicator head, the molten cosmetic being adapted to spread uniformly between the protrusions of the applicator head from said passageways by capillary action.

2. An applicator device according to claim 1, in which the heater device is adapted to heat said feed duct at the applicator head to a temperature lying in the range 35° C. to 80° C.

3. An applicator device according to claim 2, adapted to apply mascara on the eyelashes of a user, in which the heater device is adapted to heat said feed duct at the applicator head to a temperature lying in the range 40° C. to 60° C.

4. An applicator device according to claim 1, in which the thrust device comprises a spring disposed at the end of the feed duct that is remote from the applicator head.

5. An applicator device according to claim 1, in which the heater device comprises at least one resistive heater element.

6. An applicator device according to claim 1, including a control circuit having an actuating member and adapted to cause the heater device to operate for a predetermined time each time the actuator member is actuated.

7. An applicator device according to claim 6, in which said predetermined time lies in the range 30 seconds to 2 minutes.

8. An applicator device according to claim 1, in which the applicator device further comprises:

a cap adapted to cover the applicator head when said applicator is not being used; and a sensor adapted to detect the presence of the cap and then to prevent the heater device from operating.

9. An applicator device according to claim 1, having solid mascara disposed in the feed duct.

10. An applicator device according to claim 1, in which the feed duct is adapted to be opened in order to be refilled with cosmetic.

11. Use of an applicator device for applying a cosmetic by causing it to melt, the applicator device comprising:

an elongate body adapted to be held in the hand and including a rod which extends in a longitudinal direction up to a distal end, said distal end comprising an applicator head adapted to apply the cosmetic over a portion of the body of a user, said applicator head being provided with at least one row of protrusions chosen between teeth and bristles, which extend substantially perpendicular to said longitudinal direction;

a feed device adapted to feed the applicator head with cosmetic in solid form, said feed device comprising a feed duct provided longitudinally in the rod of the applicator device and communicating with passageways that are provided in the applicator head and that open out laterally to the outside between said protrusions;

a stick of solid cosmetic slidably engaged in the feed duct, said stick of solid cosmetic being adapted to melt when heated and said feed device further comprises a thrust device adapted to push the stick of solid cosmetic towards the applicator head inside the feed duct; and a heater device in the applicator head, said heater device being adapted to heat said feed duct at the applicator head and said heater device being further adapted to heat the entire applicator head, wherein said feed device feeds said stick of solid cosmetic to said heater device which heats the feed duct at the applicator head and which heats the entire applicator head, and wherein said heater device melts the stick of solid cosmetic and the molten cosmetic flows out of said passageways and spreads uniformly over the protrusions of the applicator head by capillary action.

12. The use according to claim 11, in which the cosmetic is mascara.

* * * * *